United States Patent [19]

Worst et al.

[11] Patent Number: 4,489,874

[45] Date of Patent: Dec. 25, 1984

[54] PALLET MANUFACTURING MACHINE

[75] Inventors: Joel G. Worst; William G. Grutter, both of Grand Rapids; Walter C. Bramer, Norton Shores, all of Mich.

[73] Assignee: World Wide Innovations, Inc., Grand Rapids, Mich.

[21] Appl. No.: 417,151

[22] Filed: Sep. 13, 1982

[51] Int. Cl.[3] ..... B21J 15/28; B27F 7/17; B25C 7/00

[52] U.S. Cl. ..... 227/7; 29/432; 29/525; 29/566; 29/798; 144/2 R; 144/136 B; 227/45; 227/76; 227/100; 227/141; 227/152

[58] Field of Search ..... 29/432, 525, 798, 566; 144/2 R, 2 C, 353, 136 R, 136 A, 136 B; 227/152, 45, 48, 141, 76, 100, 7; 108/51.1, 56.1, 56.3, 57.1

[56] References Cited

U.S. PATENT DOCUMENTS

| | | | |
|---|---|---|---|
| 3,681,842 | 8/1972 | Blakeslee | 227/45 X |
| 3,706,408 | 12/1972 | Burch | 227/45 |
| 3,714,696 | 2/1973 | Kay | 29/566 |
| 3,751,794 | 8/1973 | Kay | 29/526 |
| 3,763,547 | 10/1973 | Blakeslee | 227/45 X |
| 3,765,587 | 10/1973 | Davis | 227/45 |
| 3,868,898 | 3/1975 | Sanford | 227/152 X |
| 3,978,783 | 9/1976 | Moehlenpah | 227/152 X |
| 4,305,538 | 12/1981 | Schultz et al. | 227/152 X |
| 4,403,388 | 9/1983 | Belcher | 227/48 X |
| 4,403,724 | 9/1983 | Bardenstein | 227/152 X |

*Primary Examiner*—Charlie T. Moon
*Assistant Examiner*—Ronald S. Wallace
*Attorney, Agent, or Firm*—Varnum, Riddering, Schmidt & Howlett

[57] ABSTRACT

A pallet manufacturing machine and method for joining wooden slats (W) to elongate splines (S) includes spline clamping means (70) mounted on a frame (10). The spline clamping means (70) grip and release the elongate splines (S) so that the lateral edge portions of the splines (S) extend from the clamping means (70). The wooden slats (W) are carried along the length of the frame (10) by first and second advancing means (12–18, 50–56) with the advancing means (12–18, 50–56) adapted to force the slats (W) over and onto the extending edges of the splines (S). In this way, the edges of the splines (S) are embedded within the wooden slats (W) to form a contiguous structure. Drive means (76) are provided for displacing the first and second advancing (12–18, 50–56) means along the frame. In operation, the wooden slats (W) are arranged in a generally parallel, spaced relationship and the splines (S) are clamped in the clamping assembly (70). The wooden slats (W) are advanced towards one end of the clamping assembly (70) guided over and onto the edges of the splines (S) so as to embed the edges of the splines (S) in the wooden slats (W). The splines (S) are then unclamped and the assembled structure is advanced out of the other end of the clamping assembly (70).

34 Claims, 8 Drawing Figures

PALLET MANUFACTURING MACHINE

TECHNICAL FIELD

The invention relates to a machine and method for manufacturing pallets comprised of wooden slats which are arranged in top and bottom platforms joined together by metal splines.

BACKGROUND ART

The conventional wooden pallet is made up of top and bottom platforms each of which is formed by a plurality of spaced-apart wooden slats. The top and bottom platforms are joined by elongate wooden stringers. The wooden slats which make up the top and bottom platforms of the pallet are typically nailed or stapled to the elongate stringers. Alternatively, the platforms can be made of solid wooden sheets which are joined to elongate stringers.

The above-described wooden pallet, which often is assembled by hand, first requires the arrangement of the wooden slats which make up the pallet platforms into the desired configuration and then the joining of the slats to the elongate stringers by nailing or stapling. Such an assembly process is time consuming and expensive in that it requires extensive manual labor.

A pallet can also be constructed of a solid sheet or individual spaced-apart slats which are joined by elongate metal splines. The splines join the top and bottom platforms together in a contiguous structure. Such a pallet construction is shown in the commonly-owned pending application Ser. No. 203,618, filed Nov. 3, 1980, now abandoned. The above pallet construction including elongate metal splines readily lends itself to automated construction wherein the assembly of the wooden members to the splines could be carried out by machines. In this way, the need for extensive manual labor necessary in nailing or stapling the boards to the elongate supports is eliminated. An automated system of producing pallets would require very little in the way of labor.

Various types of methods and machinery for connecting a metal spline or connector to a wooden member have been proposed in the past. The manner of operation of the prior known machinery is to hold the wooden members stationary with respect to the metal splines or connectors and then force the spline or connector through the wood to embed the edges thereof in the wood. Such a method is time consuming in that one must first arrange the wooden members into the desired configuration and then force the splines into place. If a number of wooden members are used, such as in a pallet, the wood must first be arranged in a desired spacing and then while the slats are held in place, the splines must be forced into place to embed the edges in the wood. Such a process does not allow for a continuous manufacturing process. Additionally, manual labor in laying out the wooden slats in the desired arrangement is required.

Examples of prior known devices for assembling wooden members to metal splines or connectors are shown in the Kay U.S. Pat. No. 3,751,794, issued Aug. 14, 1973, the Kay U.S. Pat. No. 3,574,253, issued, Apr. 13, 1971, the Kay U.S. Pat. No. 3,714,696, issued Feb. 6, 1973, and the Kay U.S. Pat. No. 3,929,534, issued Dec. 30, 1975. The devices disclosed in the above patents all operate on the principle described above, i.e., ramming the metal splines or connectors into stationary pieces of wood.

For example, the Kay U.S. Pat. No. 3,574,253, which is used to assemble building units from wooden slats and interconnecting plates, constructs the building unit by first forming slots in the interior surfaces of the wooden members and then ramming the plates into place to connect the parallel, spaced-apart wooden members. The Kay U.S. Pat. No. 3,751,794 assembles a panel unit by placing the two opposing panel members in opposing beds which are pivotably mounted to move towards each other. Disposed within the beds are means for retaining the connector plates in place and cylinders for driving the plates through slots in the inner surfaces of the panels so as to embed the edges of the plates in the panels. If such an arrangement is used to assemble pallets, it may first be necessary to cut slots in the surfaces of the wooden slats of the pallet and then lay the slats in place on the opposing beds. Finally, the plates would be forced along the precut slots so as to embed the edges of the plates in the wooden slats. A multi-step operation of this sort would require extensive handling and positioning of the slats and connectors.

The Kay U.S. Pat. No. 3,751,794 also contemplates an assembly of panels wherein the panels are first positioned on opposing beds, as described above. The beds are then moved towards each other to force the panels onto the edges of the splines by applying sufficient pressure to the beds and panels carried thereon. In order to ensure that the panels are connected to the plates, the plates must be provided with a sharp edge portion.

The Kay U.S. Pat. No. 3,714,696 discloses another machine for advancing connector plates or splines along the length of a stationary wooden member so as to join the wooden member to the plates.

While various methods and machines for joining metal splines or connector plates to wooden members have been proposed, none provide a simple and continuous method for production of wooden pallets. In this regard, the above-described machines require the placement of the wooden members in position on a bed or stationary holding clamp prior to movement of the splines relative to the wooden members. A much more efficient arrangement would be to maintain the splines or connectors stationary relative to the wooden slats or members and drive the slats onto the edges of the splines. In this way, a continuous process wherein the arrangement of the wooden slats and the embedding on the edges of the splines is carried out in a single, continuous step is provided. Such a method and machine for carrying out this assembly process would allow for continuous construction of wooden pallets and eliminate much time consuming and expensive manual labor.

DISCLOSURE OF THE INVENTION

In accordance with the invention, wooden members and elongate metal splines are assembled into an integrated structure having two opposing, load bearing platforms. The machine includes a frame on which are mounted spline clamping assemblies which selectively grip and release elongate splines having lateral edge portions which extend from the clamps. The wooden members making up the platforms are advanced along the frame parallel to the elongate axis of the splines by advancing means. Movement of the platform members by the advancing means forces the platforms over and onto the extending lateral edges of the splines so as to join the splines to the wooden members. A drive means is provided for driving the advancing means which carry the wooden members over the splines. Further, various control means are provided for opening and closing the clamping mechanisms in synchronization with movement of the wooden members along the splines.

Typically, a pallet would include a number of wooden slats which make up the top and bottom platforms of the pallets. The slats are joined by a plurality of elongate metal splines. The assembly machine includes a number of spline clamping assemblies which correspond to the number of splines used to construct the pallet. The spline clamping assemblies include reciprocal jaw members which selectively grip and release the splines. The jaws can include pins which are received in corresponding apertures on the spline to ensure that the splines are centered and retained within the clamping assemblies.

Since the wooden members which make up the top and bottom platforms of the pallets are driven along both the upper and lower edges of the splines, it is necessary to provide a clearance beneath the splines to allow the wooden members to move over the edge of the spline. The spline clamping assemblies are normally supported from below by a vertically-reciprocating support mechanism which holds the spline clamping assemblies in place during portions of the manufacturing process. The support mechanism includes blocks which move between a first position wherein the blocks support the clamping assemblies from below and a second position wherein the blocks are out of engagement with and spaced below the clamping assembly so as to allow the wooden members to pass over and onto the edge of the splines. The operation of the support devices is controlled by trip mechanisms disposed in the path of the advancing wooden members. The trip mechanisms actuate cylinders for reciprocating the support devices in synchronization with movement of the slats over the splines.

The wooden members which make up the platforms of the pallet are advanced along the length of the frame by means of chain drives. A first set of chains carries wooden members beneath the splines so as to make up one platform of the pallet. The chains include lug means which engage the wooden members so as to carry the members down the length of the frame and over the edge of the spline.

The wooden members which pass over the top edge of the spline are carried by a second set of chains supported for rotation along the length of the frame. Since the second set of chains carries the wooden members during what normally would be considered the return travel of the chain, a third set of chains can be provided to carry the wooden members from a hopper or dispenser to the top chains.

In order to add rigidity to the pallet it is desirable to insert short splines between the top and bottom platforms of the structure in a direction perpendicular to the elongate splines. The short splines are rammed into place by means of a reciprocating piston. The edges of the short splines are thus embedded into the inner surfaces of the two platforms of the pallet.

In operation, the elongate splines are placed in the clamping assemblies which are then closed to hold the splines in position. The platform members, which are maintained in a parallel spaced apart relationship so as to form the upper and lower platforms of the pallet, are then driven over the lateral edges of the splines so that the edges become embedded in the platforms. Finally, the clamping assemblies are opened so as to release the completed structure. If it is desired to add the short splines as described above the short splines are aligned with the space between the upper and lower platforms and perpendicular to the elongate splines and then rammed into place between the platforms so as to embed the edges of the short splines in the platforms.

In accordance with the method of the invention, the platform pallets are arranged in a generally parallel, spaced apart relationship. The splines are then clamped in a stationary joining zone so that they are perpendicular to the planes in which the platforms lie. The platforms are advanced into the joining zone from one end thereof so that the platforms are guided over and onto the lateral edges of the splines so as to embed the edges in the platforms and form an assembled structure. The splines are then unclamped and the structure is advanced out of the joining zone from another end thereof.

The platforms are dispensed into the spaced apart arrangement. If the platforms include a plurality of slats, the slats are dispensed seriatim. In order to rigidify the structure, short splines are aligned with the space between the platforms and perpendicular to the elongate splines and then advanced between the platforms so as to embed the edges of the short splines in the platforms.

BRIEF DESCRIPTION OF THE DRAWINGS

The invention will be described with reference to the accompanying drawings wherein like members bear like reference numerals in which.

BEST MODE FOR CARRYING OUT THE INVENTION GENERAL

Figure 1:
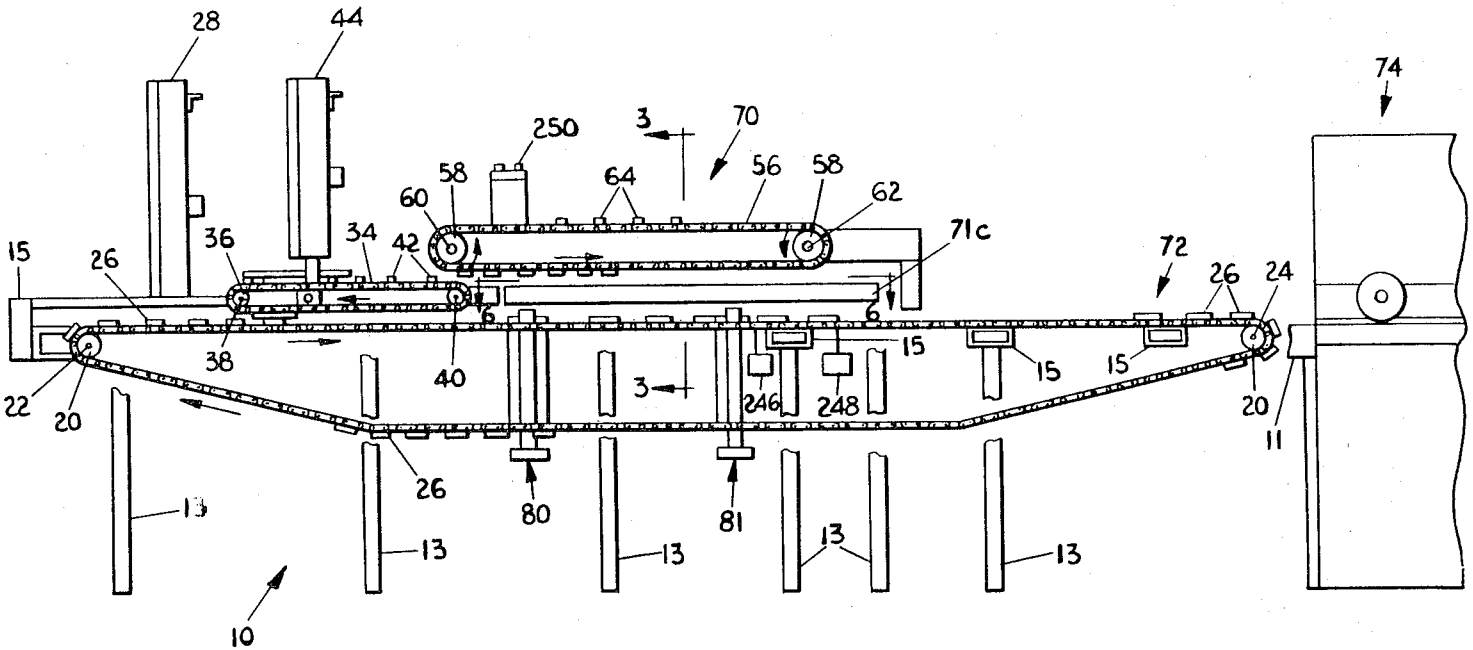
FIG. 1 is a schematic side view of a pallet manufacturing machine in accordance with the invention with portions of the frame broken away to show the slat advancing mechanisms.
Figure 2:
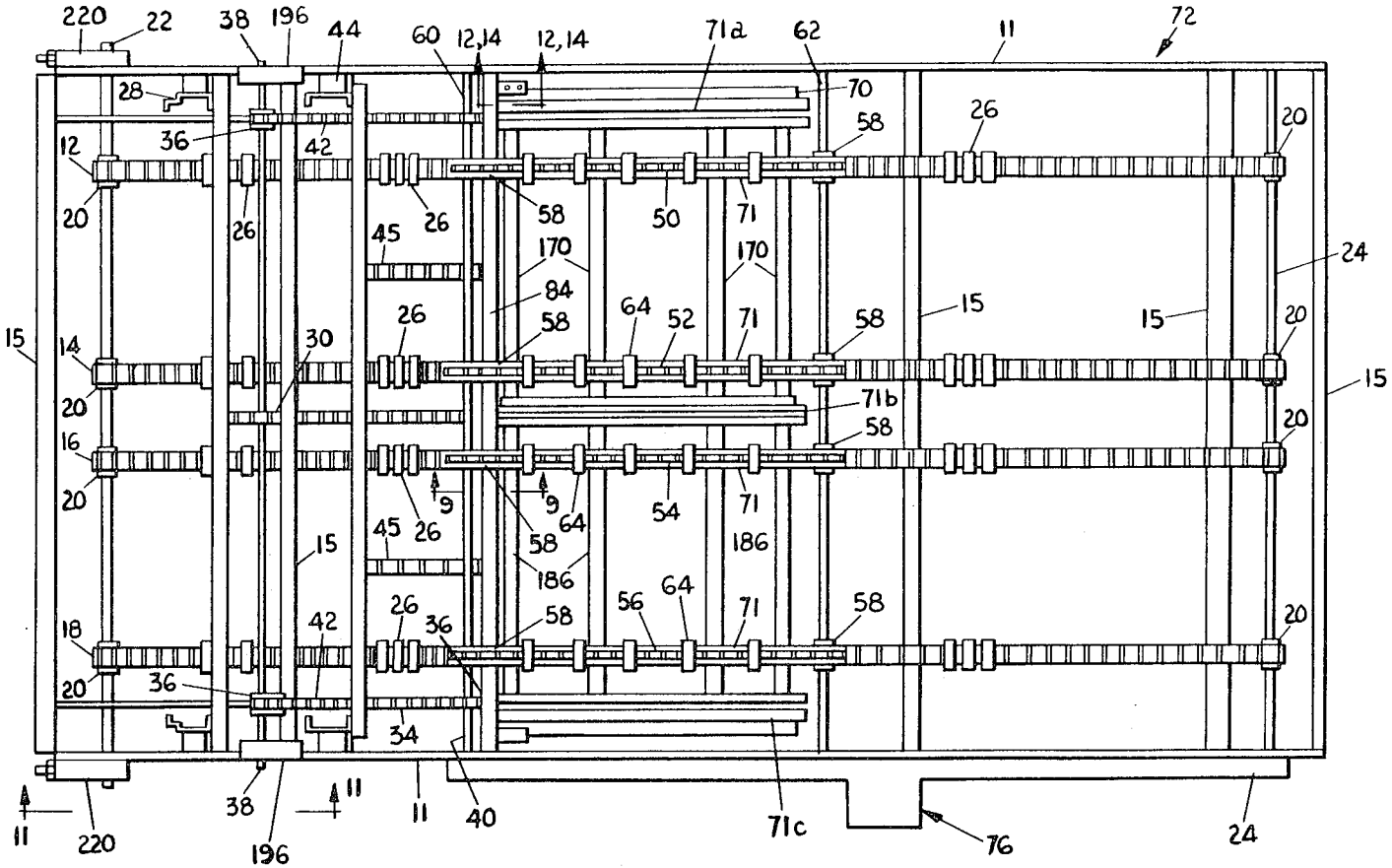
FIG. 2 is a plan view of the pallet manufacturing machine of FIG. 1.

With reference to FIGS. 1 and 2, a general description of a pallet manufacturing machine in accordance with the invention will be given. The pallet manufacturing machine is supported on a three-dimensional frame 10 made up of various structural members. The structural members include elongate side beams 11, legs 13, and cross members 15. FIG. 1 shows portions of the frame 10 broken away to expose various elements of the machine and the remaining figures will also show portions of the members of the frame 10 either in cross-section or partly broken away to expose the machine elements.

Mounted for rotation on the frame are shafts 22 and 24. The shafts are journalled at opposing ends of the frame 10 and carry sprockets 20 over which are reeved four bottom chains 12–18. The chains 12–18 carry slats W which comprise the top platform of the pallet, the pallet being formed in a reversed orientation. The chains 12–18 carry lugs 26 which support the slats W on the chains and carry the slats W along the length of the frame 10. Disposed at the forward end of the frame 10 and located above the four chains 12–18 is a hopper 28 which dispenses the wooden slats W which are assembled into the pallet onto the chains 12–18. As the chains 12–18 move under the hopper 28, the slats W are removed by the lugs 26 and are carried along the length of the frame 10. A stationary chain 30 is suspended between the hopper 28 and a cross brace 15. The stationary chain 30 lies over the center portions of the slats W carried by the bottom chains 12–18 so as to maintain the slats W square on the chains 12–18 as well as hold the slats W back against the lugs 26.

A second pair of shafts 38, 40 are journalled on the frame 10. The slats W which make up the bottom platform of the pallet are carried along the length of the frame by the transfer chains 32 and 34. The shafts support a pair of transfer chains 32 and 34 which are reeved about sprockets 36 mounted on the shafts 38 and 40. As shown in FIG. 2, the chains 32 and 34 pass beneath a second hopper 44 which stores slats W which make up the bottom platform of the pallet. In order to remove the slats from the hopper 44, the chains 32 and 34 carry lugs 42 which remove the slats from the hopper 44 as the chains 32, 34 pass thereunder. The chains 32 and 34 are disposed outside the bottom chains 12–18 which carry the bottom slats W for the pallet, as shown in FIG. 2. It is desirable to mount stationary chains 45 between the hopper 44 and a cross brace 15 on the frame 10 adjacent shaft 40 in order to provide a means for holding the slats W down on the chains 32 and 34 and against the lugs 42.

A third set of shafts 60, 62 mounted on the frame 10 carry sprockets 58 which support a set of top chains 50–56. The chains 50–56 receive the slats W from chains 32 and 34. The top chains 50–56 also carry lugs 64 which carry the slats W down the length of the frame 10. The chains 50–56 are disposed parallel to and spaced above the bottom chains 12–18 which carry the top slats for the pallet. The top chains 50–56 rotate in a counterclockwise direction so that the underside of the chains 50–56 carry the slats W along the frame.

The top chains 50–56 pass over a spline clamping assembly 70 in which the slats W carried by the bottom chains 12–18 and the slats W carried by the top chains 50–56 are joined to a plurality of elongate metal splines S. The spline clamping assembly 70 includes three clamping mechanisms 71*a–c* each of which supports an elongate metal spline. The spline clamping assembly 70 is secured to the frame 10 at its forward end in a cantilever-type fashion and supported from below by support mechanisms 80, 81, to be described below.

Disposed at the discharge end 72 of the frame 10 in a racking spline insertion unit 74 which inserts short splines R in a direction transverse to the elongate splines between the top and bottom slats W of the pallet to add rigidity thereto. All of the chains described above are driven by a common drive mechanism 76.

In operation, the hoppers 28 and 44 are loaded with wooden slats W which are to be joined to the splines S so as to form the top and bottom platforms of the pallet. The elongate splines S are then inserted into the three spline clamps 71*a–c* which form part of the spline clamping assembly 70. With the slats W and splines S in position, the machine is actuated so that the various chains are driven. Accordingly, the bottom chains 12–18, which travel in a clockwise direction, pass under the hopper 28 so that the slats drop onto the chains 12–18 and are carried along the frame by the lugs 26. The lugs 26 are spaced along the chains 12–18 so that a desired number of slats, preferably five to seven slats for a typical pallet, are removed from the hopper 28 seriatim. In a similar manner, the transfer chains 32 and 34, which also rotate in a clockwise direction (as viewed in FIG. 1) pass under the hopper 44 so that the lugs 42 on the chains 32 and 34 remove the desired number of slats W seriatim to form the bottom surface of the pallet, the pallet preferably three to five slats being formed in an inverse orientation. The slats W carried on the chains 32 and 34 are then transferred to the top chains 50–56. In this regard, the lugs 64 on the chains 50–56 are spaced so as to coordinate with the lugs 42 on the chains 32 and 34. The ends of chains 32 and 34 are adjacent sprockets 58 of chains 50–56 so that the lugs 64 on the top chains 50–56 pick off the slats W which are carried on the chains 32 and 34 for transfer into the spline clamping assembly 70. As the slats W carried on the chains 50–56 and on the bottom chains 12–18 enter the spline clamping assembly 70, the slats W are forced over the edges of the splines S which are held in the spline clamps 71*a–c*. As the slats W pass over the edges of the splines S, the edges of the splines are embedded in the slats so as to join the slats to the splines. In order to facilitate the embedding of the slats W onto the splines S, the slats W first pass over a knife edge 251 which cuts an elongate slot in the slat W in a manner to be described below. The speed of the top chains 50–56 and bottom chains 12–18 is controlled by the drive mechanism 76 so that as the leading slat W reaches the far end of the clamping assembly 70, movement of the chains has essentially stopped. Once all of the slats W have been embedded on the splines S, the movement of the chains resumes so that the completed pallet is carried out of the spline clamping assembly 70 to the discharge end 72.

The pallet is then transferred to the racking spline insertion unit 74 wherein the short splines R are driven into the edges of the slats W between the top and bottom surfaces of the pallet. The short splines R, which are generally transverse to the elongate splines S, provide additional rigidity to the pallet and prevent racking.

CLAMP SUPPORT ASSEMBLY

Figure 3:
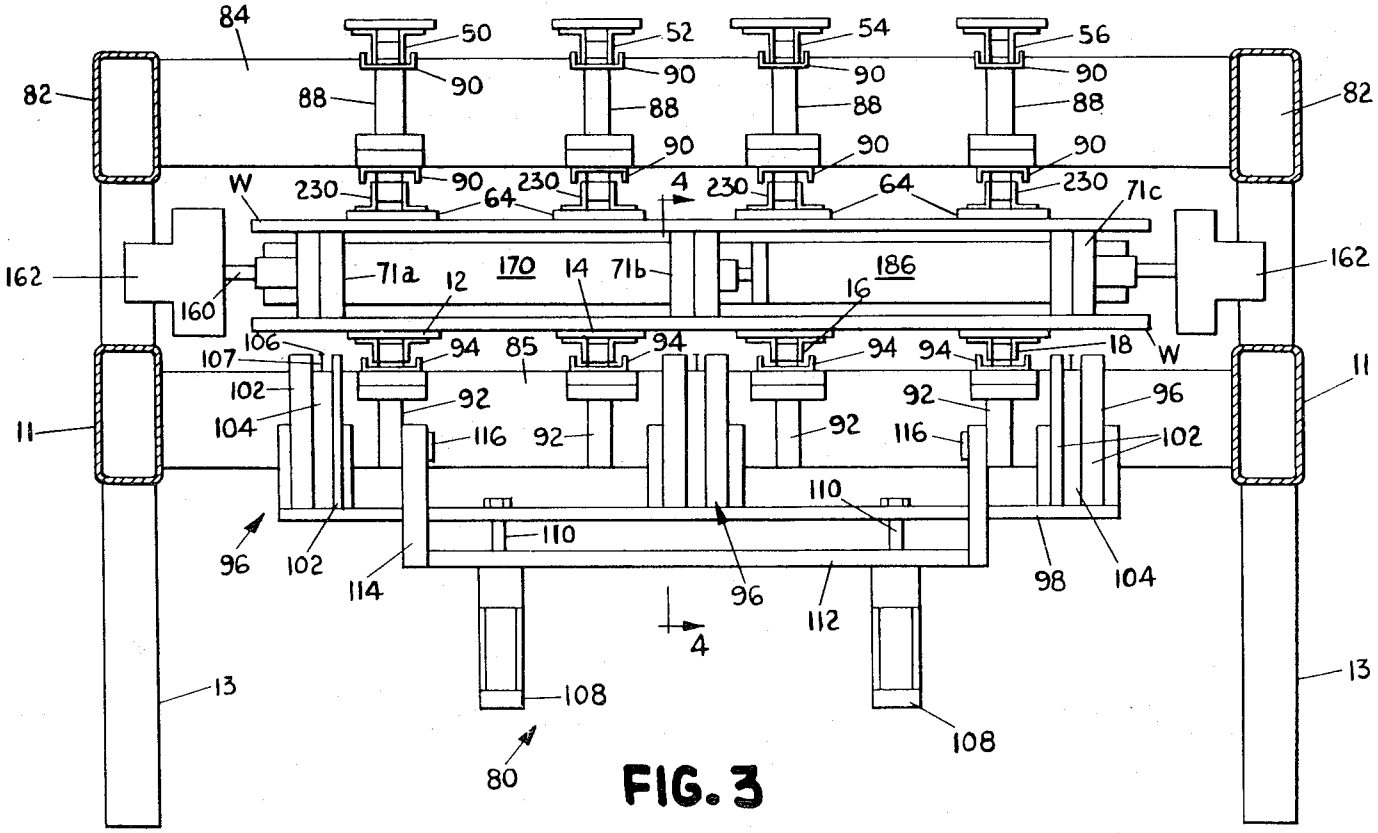
FIG. 3 is a cross-sectional view taken along line 3—3 of FIG. 1.
Figure 4:
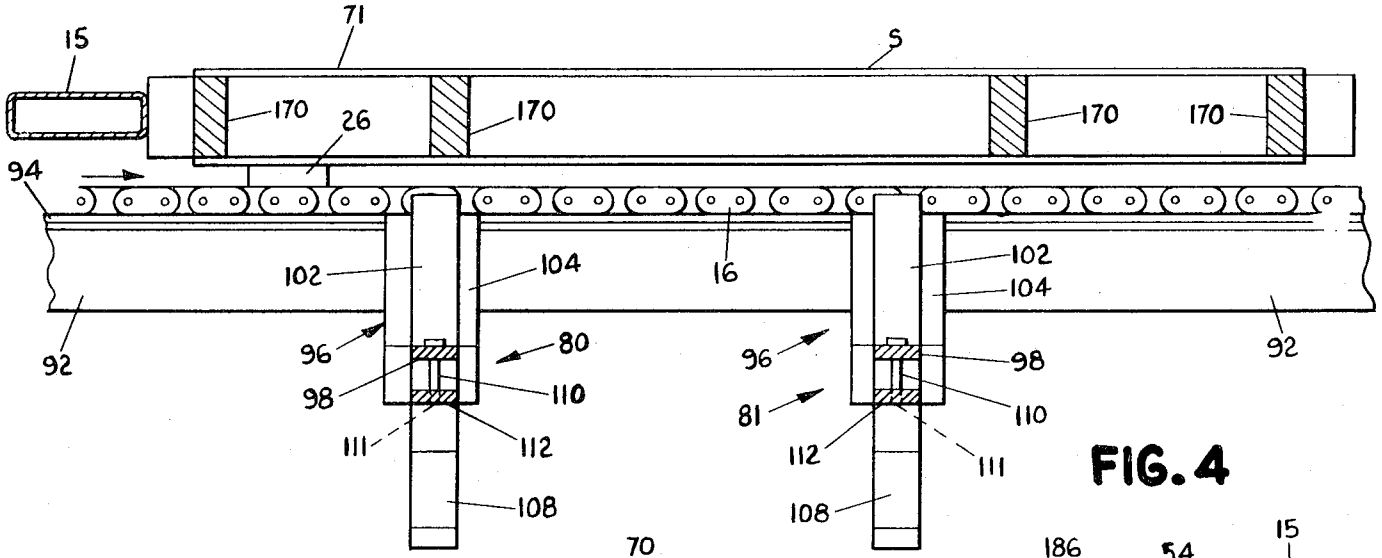
FIG. 4 is a cross-sectional view taken along line 4—4 of FIG. 3.

With reference to FIGS. 3 and 4, two support mechanisms 80 and 81 for the spline clamping assembly 70 are shown. The support mechanisms 80 and 81 are mounted below the spline clamping assembly 70 and serve to support the clamps 71*a–c* which make up the spline clamping assembly 70 while the slats W are carried to the clamping assembly.

Clamps 71*a–c* have a height approximately equal to the spacing distance between the slats W in the finished pallet. The leading edge of each clamp 71*a–c* has a dimension which is the precise vertical distance between the slats W but this dimension decreases slightly from the leading edge to reduce frictional drag between the slats W and the clamps as the slats W move along the splines S.

The top chains 50–56 are supported by longitudinally extending steel members 88. The steel members 88 are welded or secured at each end to cross braces 84 of the frame 10. The cross braces 84 are supported between longitudinally-extending frame members 82. Each chain 50–56 rides in a shallow U-shaped guide 90 which is secured to the steel member 88. The steel members 88 which support the chains 50–56 have an inverted T-shaped configuration. As can be seen in FIG. 3, the chains 50–56 ride in the guides 90 so that the lugs 64 thereof carry the slats W over the length of the splines S.

The bottom chains 12–18 likewise are supported on T-shaped steel members 92 which are also welded or secured at each end to cross braces 85 of the frame 10. The cross braces 85 are welded between side beams 11. The T-shaped steel members 92 mount a shallow U-shaped guide 94 in which the chains ride so that the lugs 26 extend upwardly so as to carry the slats W which make up the top platform of the pallet under the splines S.

The clamps 71*a–c* which form part of the clamping assembly 70 and the mechanism for operating the clamps will be described below.

Each support mechanism 80, 81 includes three supports 96 each of which is disposed beneath a clamp 71*a–c*. The supports 96 are secured to a rectangular steel bar 98 which extends across the width of the frame 10. The supports 96 are mounted in a U-shaped bracket 100 which comprises two upstanding legs welded to the bar 98. Each support 96 has three sections, two outer sections 102 preferably made of steel plate having the same height and an inner or central plate 104 which is welded between the two outer plates 102. The assembly of the two outer plates 102 and the central plates 104 is secured between the legs of bracket 100 so that the height can be adjusted within the bracket 100. Extending from the top surface of the central plate 104 is a pad 106 secured to a screw 107 threaded into the plate 104. It can be seen from FIGS. 3 and 4 that when the supports 96 are reciprocated to an up position, the two outer plates 102 engage the under surface of the opposing members of one of the clamps 71*a–c* while the pad 106 supports the bottom portion of the spline. The two support mechanisms 80, 81 are secured under the spline clamping assembly 70 and are spaced along the length of the frame 10. In this way, the clamps 71*a–c* and the splines S held therein are supported at two points along the length thereof from below. The spline clamping assembly 70 is also secured at the forward end thereof to the frame 10.

Cylinders 108 reciprocate the supports 96 in coordination with movement of the slats W through the machine. The cylinders 108 are preferably hydraulic cylinders. Each cylinder 108 is secured to a steel bar 112 which extends parallel to and is spaced below the steel bar 98 to which the supports 96 are mounted. The cylinder 108 is operatively connected to a rod 110 which passes through a bore 111 in the steel bar 112 and is connected to the steel bar 98 on which the supports 96 are mounted. Thus, actuation of the cylinder 108 causes bar 98 and the attached supports 96 to reciprocate and support the clamps 71*a–c* as needed. The steel bar 112 is secured at each end to upstanding legs 114 which have a generally U-shaped configuration. The steel member 98 is received in the open space between the legs 114 so as to allow for reciprocation thereof. The legs 114 are bolted or otherwise secured to the T-shaped members 92 over which the bottom chains 12–18 ride.

It thus can be seen that the support mechanisms 80 and 81 provides a means for supporting the clamps 71*a–c* during the pallet manufacturing operation. In this regard, the supports 96 are reciprocated to an up position at the beginning of a pallet manufacturing cycle when the bottom chains 12–18 and transfer chains 32 and 34 begin removing slats W from their respective hoppers 28 and 44. As the slats W enter the spline clamping area 70, the cylinders 108 for the forward mechanism 89 are retracted, thus moving the bar 98 and attached supports 96 out of the path of the advancing slats W. In this way, the bottom slats W pass under the spline S and become embedded thereon. As the slats W pass further down the frame, the second support mechanism 81 drops down out of the path of the slats W due to the retraction of the cylinder 108. The operation of the control devices for the support mechanisms 80 and 81 will be described below with reference to FIG. 5. After completing the joining of the slats W to the splines S, the assembled pallet is then discharged from the spline clamping area 70 at which time the cylinders 108 are actuated to reciprocate the supports 96 into an up position so as to again support the clamps 71*a–c*.

TRIP MECHANISM FOR CLAMP SUPPORTS

Figure 5:
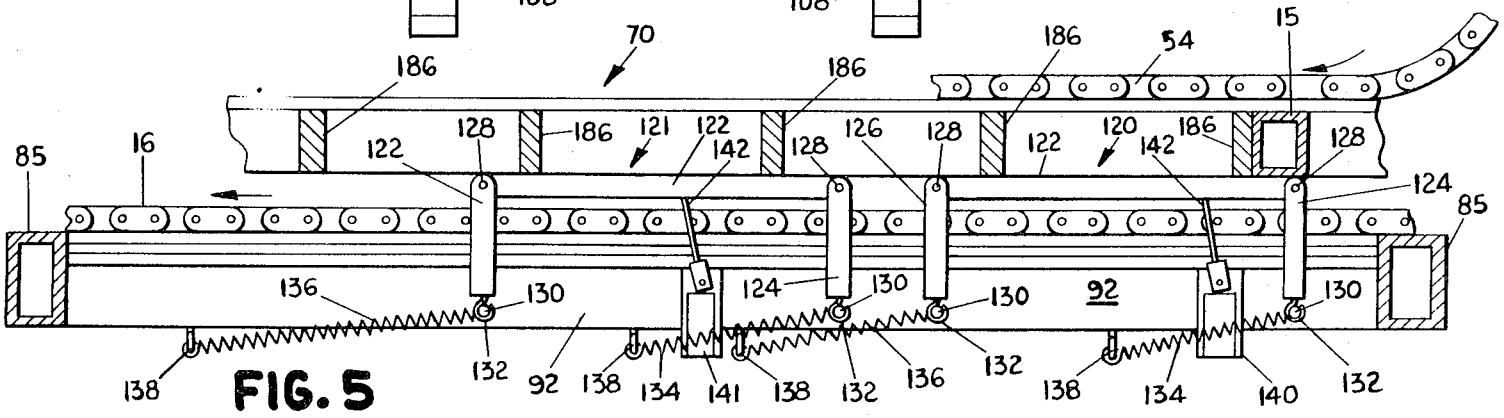
FIG. 5 is a cross-sectional view taken along line 5—5 of FIG. 3 and showing a clamp support trip mechanism.
Figure 6:
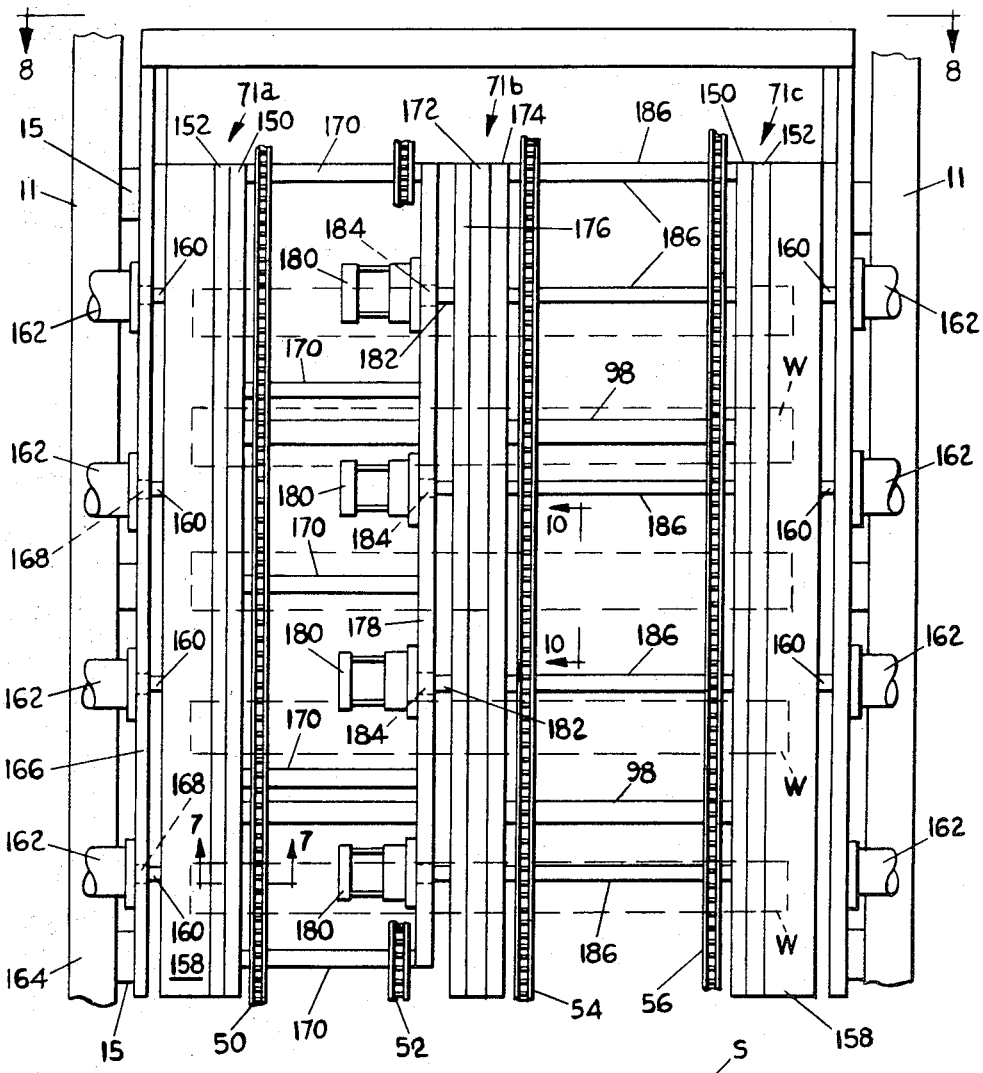
FIG. 6 is a detailed plan view of the clamping mechanism seen along line 6—6 of FIG. 1.

FIG. 5 illustrates the device for extending and retracting the above-described support mechanisms 80 and 81. The control device includes trip mechanisms 120 and 121 in the form of a three bar linkages having a center bar 122 and two arms 124 and 126. The arms 124 and 126 are pivotably joined to the center bar by pins 128. The arms 124 and 126 are pivotably mounted to one of the members 92 which extends along the length of the chains in the spline clamping assembly 70. The arms 124 and 126 are pivoted on pins 130 which extend from the side portions of the members 92. Eye hooks 132 are secured at the bottom portions of the arms 124 and 126. Extending between each eye hook 130 secured to arms 124 and 126 and a stationary eye hook 138 mounted to the member 92 are coil springs 134 and 136. The coil springs 134 and 136 provide a biasing force for maintaining the trip mechanisms 120, 121 in the upright or undeflected position as shown in FIG. 4*a*. Adjacent each trip mechanism 120, 121 is a switch 140, 141 which includes an arm or probe 142 which extends upwardly therefrom. The switch 140, 141 is connected with the cylinders 108. The switch 140, 141 causes the cylinders 108 to either extend or retract and thus reciprocate the support mechanisms 80, 81.

In operation, the trip mechanisms 120, 121 are in the undeflected or up position, as shown in FIG. 5 at the start of a pallet manufacturing cycle. As the slats W advance into the spline clamping assembly 70, the slats W cause the first trip mechanism 120 to deflect in the direction of travel of the slats W. As the trip mechanism 120 deflects, it engages the arm 142 of the switch, thus generating a signal which causes the cylinders 108 of the first support mechanism 80 to retract and cause the supports 96 to drop out of the path of the advancing slats W. During this time, the clamps 71*a–c* are supported at the far end by the second support mechanism 81. Continued travel of the chains and slats W carried thereon causes the slats W to engage the second trip mechanism 121 and cause deflection thereof. As the second trip mechanism 121 deflects, it engages the arm 142 of the second switch 141 which generates a signal to retract the cylinders 108 of second support mechanism 81. After the completed pallet has passed through the spline clamping assembly 70, the coil springs 134 and 136 cause the trip mechanisms 120, 121 to return to the upright or undeflected position so that the pallet manufacturing cycle may be repeated. The two trip mechanisms 120, 121 thus provide a means for extending and retracting the clamp supports 80, 81 so as to allow for passage of the slats through the clamping assembly 70.

SPLINE CLAMPING ASSEMBLY

The spline clamping assembly 70 which is shown generally in FIGS. 1 and 2 is shown in greater detail in FIGS. 3, 6, 7 and 8. The spline clamping assembly 70 includes three clamps 71*a–c*, the two outermost clamps designated as 71*a* and 71*c* and the center clamp designated as 71*b*. The outer clamps 71*a* and 71*c* are identical but have a reversed orientation. As can be seen, the spline clamping assembly 70 is disposed between the top chains 50–56 and the bottom chains 12–18. Thus, the spline clamping assembly 70 holds the splines S in place between the top and bottom slats which are joined to the splines S to form the pallet.

Figure 7:
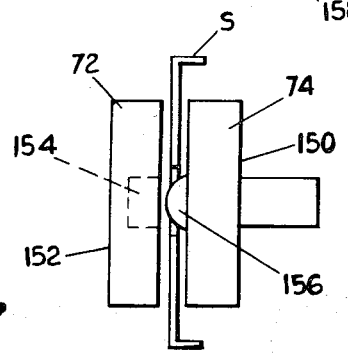
FIG. 7 is a cross-sectional view taken along line 7—7 of FIG. 6.
Figure 8:
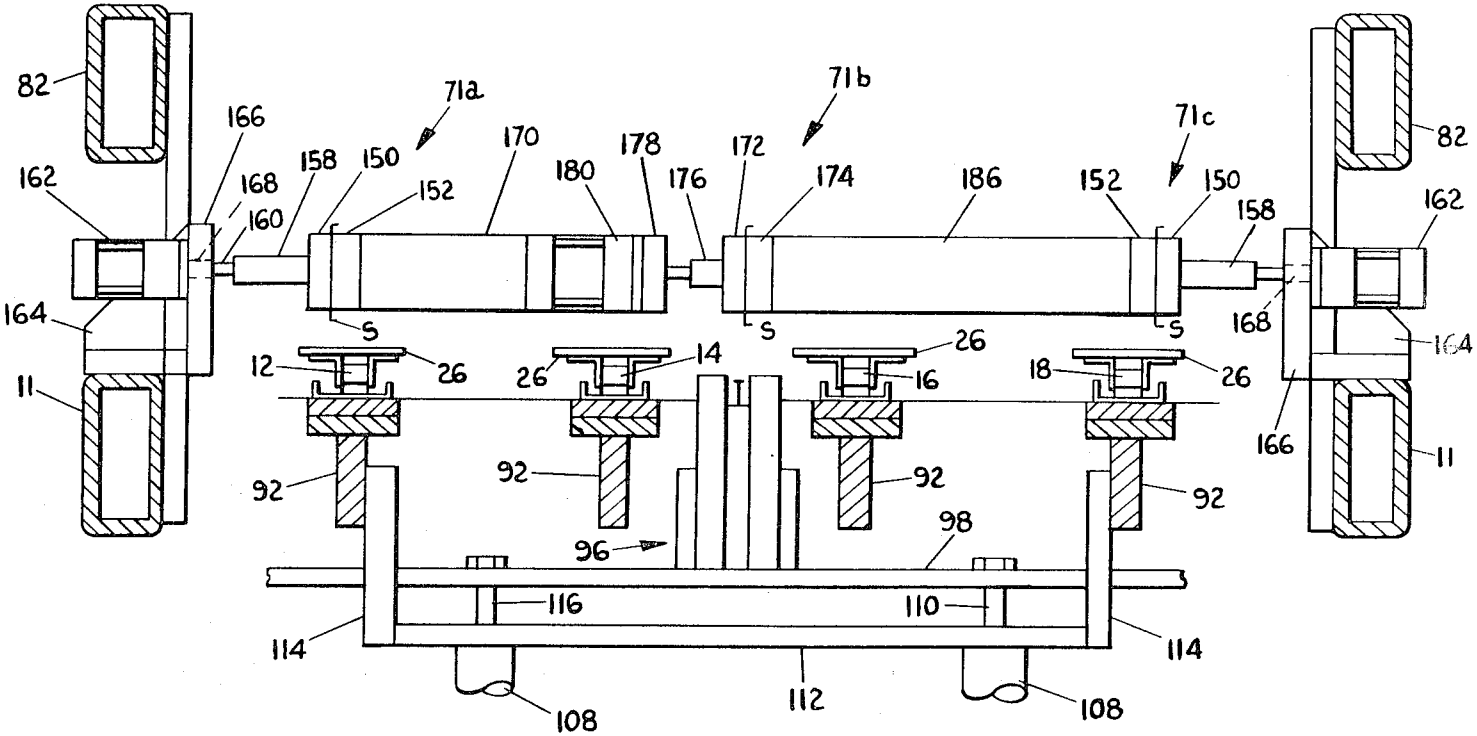
FIG. 8 is a cross-sectional view taken along line 8—8 of FIG. 6.

The outer clamps 71*a* and 71*c* include two opposing face or jaw members 150, 152. The faces 150, 152 are in the form of elongate rectangular steel stock having a length slightly greater than that of the spline and a height slightly less than the spline S. Thus, the edges of the spline S extend from the clamps so that the slats W which pass over the spline can be joined thereto. Each face or jaw 150 includes at least two apertures 154 spaced along the length thereof while the opposing face 152 includes a pin 156 which is received in the aperture 154 when the clamp is in a closed position. This configuration is shown in FIG. 7. The splines S include holes which correspond to the location of the pins 156 on the faces 152 so that when the clamps 71 are in a closed position, the spline S is retained in the clamp by the pin 156 and the pressure exerted by the opposing faces 150 and 152.

Secured to the face 150 is an elongate rectangular block 158 which serves to reinforce the clamp and distribute the clamping force evenly over the face 150. The clamping force is transmitted to the clamp by means of rods 160 which are connected with cylinders 162. The cylinders 162 are mounted on a member 164 which forms part of the frame 10. The cylinders 162 are further secured to a plate 166 which is mounted to the member 164. The plate 166 includes a number of bores 168 therethrough through which the rods 160 extend. The face 152 on the clamp 71*a*, c is held stationary with respect to the opposing face 150, with the face 152 being secured to a plurality of cross braces 170 which connect the outer clamp 71*a* to the center clamp 71*b*.

The center clamp 71*b* includes two opposing faces 172 and 174 similar to those described with reference to the clamp 71*a,c*. The faces 172, 174 are elongate steel members having a rectangular configuration. The faces 172 and 174 include a pin and aperture arrangement as shown in FIG. 7. An elongate block 176 is secured to face 170, with the block 176 serving to reinforce the face and provide for equal distribution of the clamping load over the face. The face 172 is mounted for reciprocating movement against face 174 by means of cylinders 180 which include extending piston rods 182 connected to the block 176 in a manner similar to that described above with reference to clamp 71*a*. The cylinders 180 are mounted to a plate 178 which is secured to the cross braces 170 which extend between the clamps 71*a* and 71*b*. The piston rods 182 extend through bores 184 in the plate 178. The stationary face 174 is secured to the third clamping area 71*c* by means of cross braces 186.

The third clamp 71*c*, as described above, is identical to clamp 71*a* except that it has a reverse orientation. The stationary jaw of clamp 71*c* is secured to the central clamp 71*b* by means of the cross braces 186.

In operation, splines S are inserted between the faces of the three clamps 71*a–c* at the beginning of a pallet manufacturing cycle during which time the clamps 71*a–c* are in an open position. When the machine is actuated, the cylinders 162, 180 are actuated so as to close the clamps 71*a–c* and hold the splines S therein, with the splines being centered by the pins 156 carried on interior of the faces 152 and 174. The splines S and clamps 71*a–c* are supported from below by the support mechanisms 80 and 81 shown in FIGS. 3 and 4 and described above. As the slats advance through the spline clamping assembly 70 due to movement of the upper and lower chains, the slats W are embedded onto the edges of the splines S which extend from the clamps 71*a–c*. When the leading slat reaches the far end of the spline clamping assembly 70, the clamps open so as to release the spline S which now has been joined to the slats. Thus, continued travel of the chains will cause the assembled pallet to be discharged from the spline clamping assembly. The cycle is then repeated.

TRANSFER CHAINS

Figure 9:
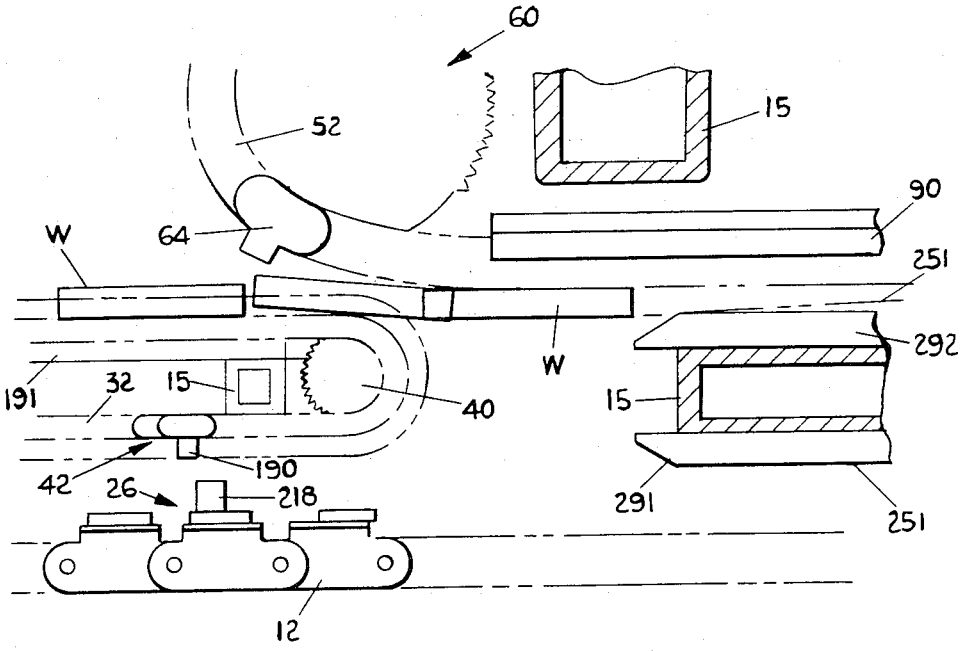
FIG. 9 is a detailed view of the chain drive mechanism seen along line 9—9 of FIG. 2.
Figure 10:
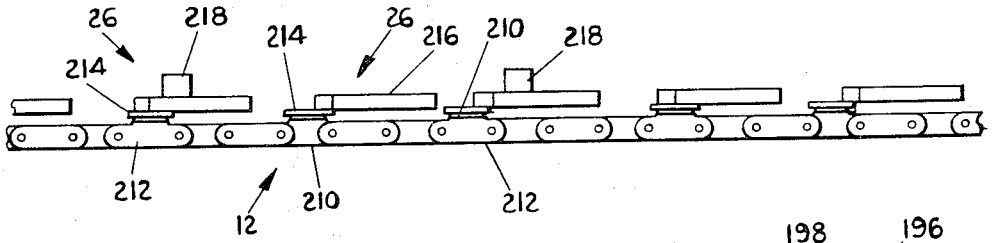
FIG. 10 is a detailed view of a bottom chain seen along line 10—10 of FIG. 6.
Figure 11:
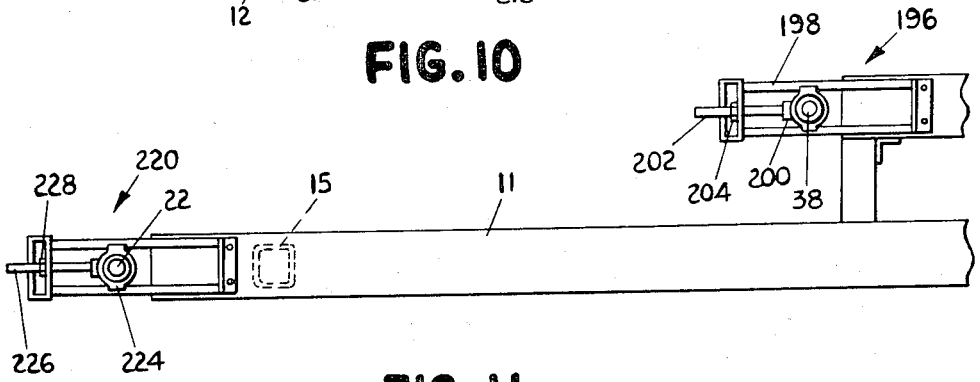
FIG. 11 is a detailed view of the shaft adjustment mechanism seen along line 11—11 of FIG. 2.

The transfer chains 32–34 which carry the slats W which make up the bottom platform of the pallet from the hopper 44 to the top chains 50–56 are reeved about sprockets mounted on shafts as described above. The chains are preferably American Standard Size No. 50 and thus have a pitch of $\frac{5}{8}$ of an inch. The chains 32, 34 mount lugs 42 which are spaced along the length of the chain as shown in FIG. 9. The lugs 42 are secured to the sides of the link plates of the chains 32, 34 and include upstanding flange portions 190 which extend parallel to the link plates of the chains. The flange portions 190, which extend above the top of the chain, serve as a means for removing slats S from the hopper 44 as the chains pass thereunder. The chains 32 and 34 ride over a support beam 191 which form part of the frame 10 so as to prevent sagging of the chain between the sprockets. As can be seen in FIG. 9, the shaft 40 which supports sprocket 36 of the transfer chains 32–34 is mounted slightly forward of the shaft 60 which supports the sprockets 58 for the top chains 50–56 which transfer the slats W through the spline clamping assembly 70. The sprockets and the lugs carried on the respective chains are arranged so that as the slats W are carried to the ends of chains 32 and 34, the lugs 64 on chains 50–56 pick up the slats W and carry the slats W through the spline clamping assembly 70. As the transfer chains 32–34 pass over the sprockets 36, they are accelerated slightly due to the curvilinear motion. In this way, the lugs 42 carried on the transfer chains 32 and 34 are also accelerated and thus push the slats W forwardly into engagement with the lugs 64 carried on chains 50–56.

The shaft 38 on which the sprockets 36 for the transfer chains 32 and 34 are mounted is secured in an adjustable bearing assembly 196. The adjustable bearing assembly 196 includes mounting brackets 198 having a generally rectangular configuration. Secured to the brackets 198 for sliding movement therein is a bearing 200 which supports an end of the shaft 38. Secured to the bearing 200 is an elongate threaded rod 202 which has an end extending through the bracket and received in a nut 204. Accordingly, rotation of the nut 204 causes a lateral shifting of the bearing 200 which in turn causes movement of the shaft 38 for alignment. In this way, precise alignment of the shaft 38 and sprockets 36 thereon can be accomplished.

BOTTOM CHAINS

With reference to FIGS. 3, 4, 9, 10 and 11, the bottom chains 12–18 will be described. The bottom chains 12–18 are reeved over sprockets 20 mounted to shafts 22 and 24 disposed at opposite ends of the frame 10 as described above. The bottom chains can be C2102H or equivalent double pitch 100. The chains mount lugs 26 which carry slats W down the length of the frame 10 and through the spline clamping assembly 70.

The lugs 26 comprise two generally right angle shaped brackets 210 each of which is secured along the vertical flange 212 thereof to an opposing link plate of the chain. The leg 214 of the bracket 210 is thus placed at generally right angles to the direction of travel of the chain. Secured across the legs 214 of the brackets 210 is a rectangular plate 216 which forms part of the lug 26. The plate 216 is preferably bolted or welded to the brackets 210. The plates 216 provide a flat surface for transporting slats down the length of the frame for assembly into a pallet. To selected plates 216 are secured square blocks 218 which extend across the width of the plate. The blocks serve as a means for removing slats from hopper 28 as the chains pass thereunder. The blocks 218 are preferably welded to the plates 216 and the distance between adjacent blocks 218 is selected so that a predetermined number of slats are removed from the hopper. Preferably, the spacing of the blocks 218 is based on $1\frac{1}{4}$ inch increments. The block 218 can be mounted to the front, middle or end portion of the plate 216 in order to maintain the desired spacing between lugs 26. The number of slats W to be removed depends upon the desired number of slats W which make up the platform of the pallet. Further, the spacing between the blocks 218 secured to the plates 216 on the chains 12–18 is selected so that the slats are arranged in a predetermined spacing as they pass through the spline clamping assembly 70.

The shaft 22 supporting the forward ends of the chains 12–18 is mounted in an adjustable bearing assembly 220 similar to that described above with respect to the transfer chains 32 and 34. In this regard, the bearing assembly 220 includes a rectangular bracket 222 having an open interior in which is mounted a bearing 224 for sliding movement. The bearing 224 supports an end of the shaft 22. Extending from the bearing 224, as shown in FIG. 9, is an elongate threaded rod 226 which extends through one of the side portions of the bracket and to which is received in a nut 228. Turning of the nut 228 causes the rod 226 to be displaced along its axis and in turn displaces the bearing 224 and shaft 22 supported therein. The adjustable bearing assembly 220 allows for precise alignment of the shaft 22 and attached sprockets with respect to the remainder of the frame and also allows for servicing of the chains as needed.

TOP CHAINS

The top chains 50–56 which transfer the slats W which comprise the bottom surface of the pallet to the spline clamping assembly are shown in FIGS. 3, 4 and 9. The top chains 50–56 are reeved about sprockets supported on shafts as described above.

The top chains mount lugs 64 which carry the slats W through the spline clamping assembly 70. Each lug 64 comprises two upstanding plates 230 secured to the link plates of the chain. The lugs 64 can be secured to the interior or exterior of the link plates. The plates 230 include upwardly extending flanges 232. Secured across the flanges 232 and perpendicular to the direction of travel of the chains is a rectangular plate 234 which serves as a means for pushing the slats W through the spline clamping assembly 70. The plate 234 is preferably welded across an end portion of each upstanding flange 232. The lugs 64 are spaced apart along the chains 50–56 a selected distance so as to dispose the slats carried thereby along the length of the spline in the spline clamping assembly 76. As can be seen in FIG. 7, the axis of shaft 60 which supports the forward end of the chains 50–56 is slightly forward of the axis of shaft 38 which supports the transfer chains 32–34. In this way, the lugs 64 carried on chains 50–56 engage the rear of the slats carried on the transfer chains 32–34 so as to push the slats through the spline clamping assembly 70.

The top chains 50–56 preferably are American Standard No. 100 and thus have a pitch of $1\frac{1}{4}$ inches. The lugs 64 are spaced apart on the basis of $1\frac{1}{4}$ inch increments to correspond to the spacing of the lugs 26 on the bottom chains 12–18.

DRIVE ASSEMBLY AND CONTROL MECHANISM

Figure 12:
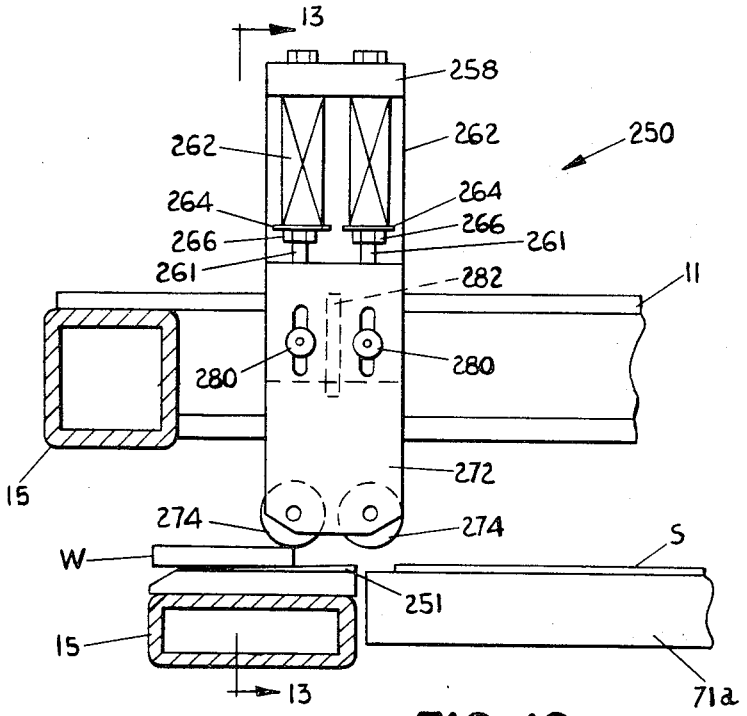
FIG. 12 is a detailed side view of the slat hold down mechanism seen along line 12—12 of FIG. 2.

The bottom chains 12–18, transfer chains 32 and 34 and top chains 50–56 are all driven by a common drive mechanism shown in FIGS. 2 and 12. The common drive mechanism 76 includes a hydraulic motor M capable of being driven at varying speeds. The motor M is operably connected with shaft 24 which drives the bottom chains 12–18, shaft 60 which drives top chains 50–56 and shaft 40 which drives the transfer chains 32 and 34. The drive shafts 24 and 60 for the top and bottom chains are interconnected by means of appropriate gearing of and connected to the motor by a coupling or the like. The drive ratio maintained by the gears connected with the top and bottom chains is one to one so as to synchronize movement of the chains at a common speed. Drive shaft 40 which drives the transfer chains is operatively connected with the motor by means of a chain and sprocket which provides a drive ratio of one to one with the gearing on the top and bottom drive shafts. In this way, all three sets of chains are driven by the common drive mechanism in synchronization.

The speed of the motor M is adjustable so as to adjust the rate at which the chains and thus the slats W move through the spline clamping assembly 70. The motor must develop a sufficient torque so that the slats W, while in the spline clamping assembly 70, are driven with sufficient force so that they become embedded on the edges of the splines S. In this regard, the force exerted by the chains during driving thereof must overcome the resistance posed by the edges of the splines as the slats are forced over the splines.

A control device C for the motor M and the various cylinders which actuate the spline clamps 71*a–c* and support mechanisms 80, 81 is connected with switches 246 and 248 disposed in the spline clamping area 70. (See FIGS. 1, 20). The first switch 246 decelerates the chains and the second switch 248 stops the chain drive momentarily to allow the clamps 71*a–c* to open and release the pallet. The switches 246 and 248 are tripped by either of the leading slats carried by the top and bottom chains as the slats pass through the clamping assembly 70. It thus can be seen that actuation of the motor M and thus driving of the chains is controlled by the switches 246 and 248.

Figure 20:
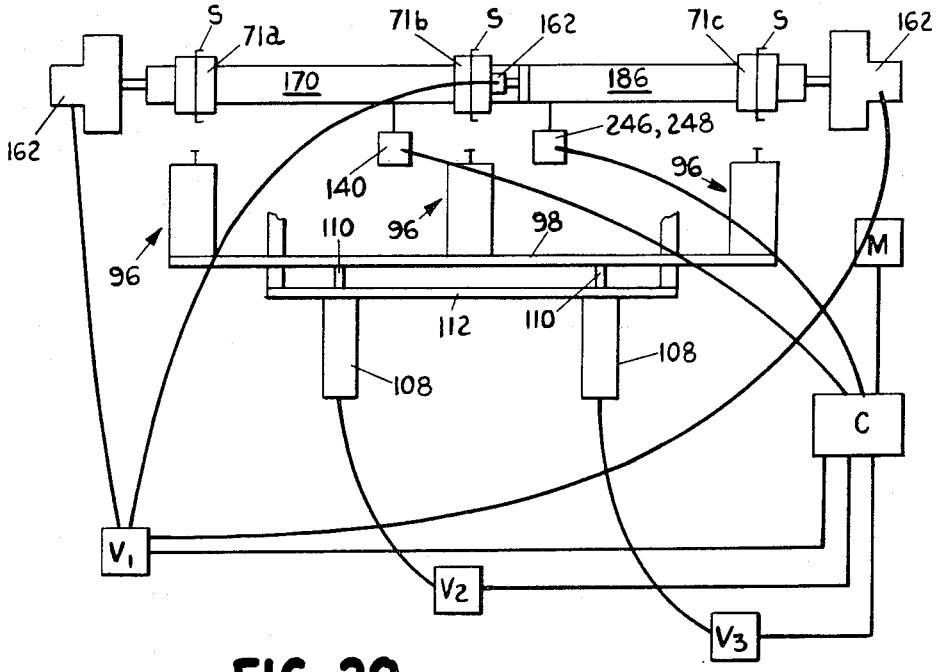
FIG. 20 is a schematic of the control circuit for regulating operation of the various cylinders of the invention.

The signal generated by the switch 248, which stops the chain drive, also retracts the cylinders 162 which hold the spline clamps 71*a–c* in the closed position. As can be seen in FIG. 20, the control device C regulates the operation of valve $V_1$ which actuates and deactuates the clamps 71*a–c*.

Switches 140, 141, which regulate operation of the air cylinders 108 which control the support mechanisms 80, 81, are also connected with the control device C. The signals generated by the switches 140, 141 cause the control device C to open and close valves $V_2$ and $V_3$ so as to extend and retract the air cylinders 108 and thus reciprocate the support mechanisms.

HOLD DOWN DEVICES

Figure 13:
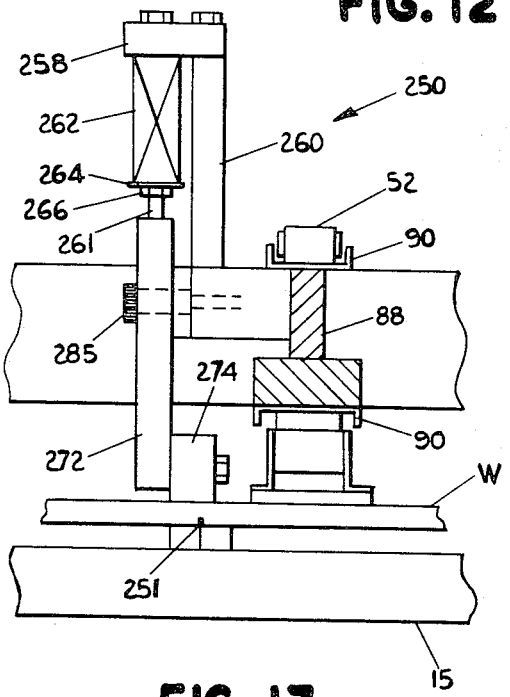
FIG. 13 is a view taken along line 13—13 of FIG. 12.

FIGS. 12 and 13 show hold down devices 250 which exert pressure against the slats W as they enter the spline clamping assembly 70.

Each hold down 252, 254 includes an L-shaped bracket which is secured to a frame member on the machine, preferably by welding. The bracket may be formed in two pieces wherein a leg 258 is bolted to a vertical or upstanding portion 260 of the bracket. Secured to the leg 258 and disposed in a vertical orientation are two rods 261 laterally spaced apart and parallel to the vertical leg 260 of the bracket. The rods 261 mount coil springs 262 which are seated between the leg 258 of the bracket and a washer 264 held in place on the rod 261 by means of a nut 266 which is threadably mounted to the rod 261. The ends of the rod 261 are secured to a rectangular block 272 on which are mounted two spaced apart rollers 274. The rollers 274 are secured to the block 272 by pins 276. The block 272 includes two vertically extending slots 278 which provides a means for mounting the block 272 to a frame member. The block 272 is secured to the frame by means of bolts 280 which extend through the elongate slots 278 so vertical positioning of the block 272 and rollers 274 can be accomplished. In order to maintain the block 272 and thus the rollers 274 perpendicular to the direction of travel of the slat, the block 272 includes a keyway 282 which receives a key on the adjacent frame member 11. The key and keyway 282 maintain the vertical orientation of the hold down 250.

It thus can be seen that each pair of hold down devices 250 provides a pressure against the slat W which maintains it in contact with a knife edge 251 for scoring. As can be seen in FIG. 13, the distance between the top edge of the knife 251 and the bottom of the roller 274 is less than the height of the slat W. Thus, as a slat W enters into the space, the force exerted by the coil springs 262 force the slat W over the knife edge 251, with the rollers 274 allowing the forward movement of the slats W.

SCORING MECHANISM

Figure 15:
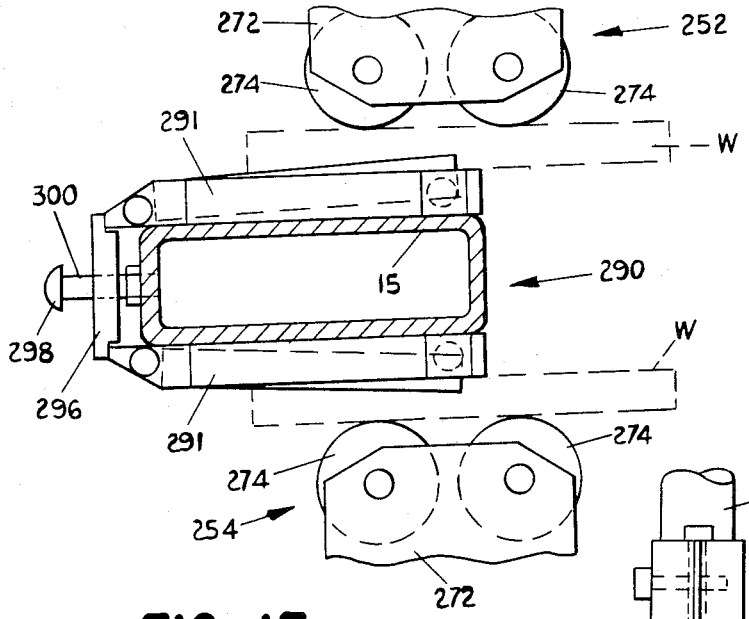
FIG. 15 is a view of the scoring mechanism seen along line 15—15 of FIG. 14.
Figure 14:
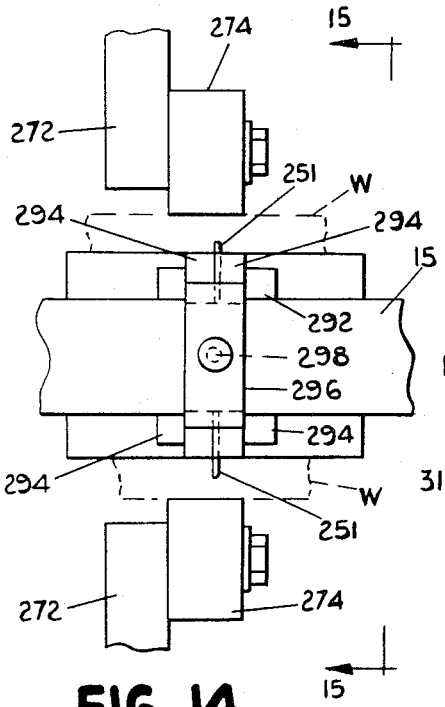
FIG. 14 is a detailed view of the scoring mechanism seen along line 14—14 of FIG. 2.

FIGS. 14 and 15 show a mechanism 290 for scoring the inner surfaces of the slats W as they pass into the clamp assembly 70.

The scoring mechanism 290 includes two blades 291 mounted to a holder 292 which is secured on a cross brace 15 of the frame. Each blade 291 has a serrated edge which extends from the holder 292. The holder 292 is in the form of a clamp having two opposing jaw members 294 which facilitate insertion and removal of the blades 291 as necessary. The blades 291 are received in a slot between the jaw members 294. If desired, a spring-biased end piece 296 can be mounted across the upper and lower jaw members 294 to hold the jaw members 294 in place. The end piece 296 is secured to the cross brace of the frame 15 by means of a spring-biased bolt 298. The jaw members 294 may be easily removed by forcing the end piece 296 against the bias of the spring 300 so as to disengage a shoulder on the end piece 296 from the end of the jaw members 294 and thus allow the jaw members 294 to be lifted out of the holder 292 for quick replacement. The spring-biased and piece 296 is optional and allows for easy replacement of the blades.

The blades present a generally angled knife edge 251 so that as the slat W engages the scoring mechanism 290, it rides over the knife edge 251 and is maintained in contact therewith by the hold down 250 as described above. The angled knife edge 251 facilitates scoring of the slats and does not present an abrupt edge which would impede forward advancement of the slats W by the chains. The slats W are scored to facilitate embedding onto the edges of the splines S.

RACKING SPLINE ASSEMBLY UNIT

Figure 16:
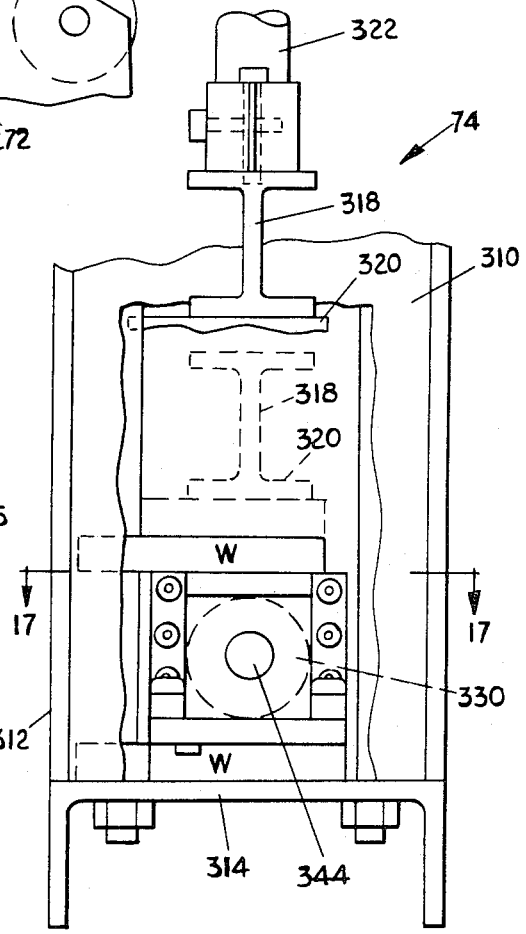
FIG. 16 is a side view of the racking spline insertion assembly shown schematically in FIG. 1.

With reference to FIGS. 15 and 16, the racking spline assembly unit 76 is shown.

Figure 17:
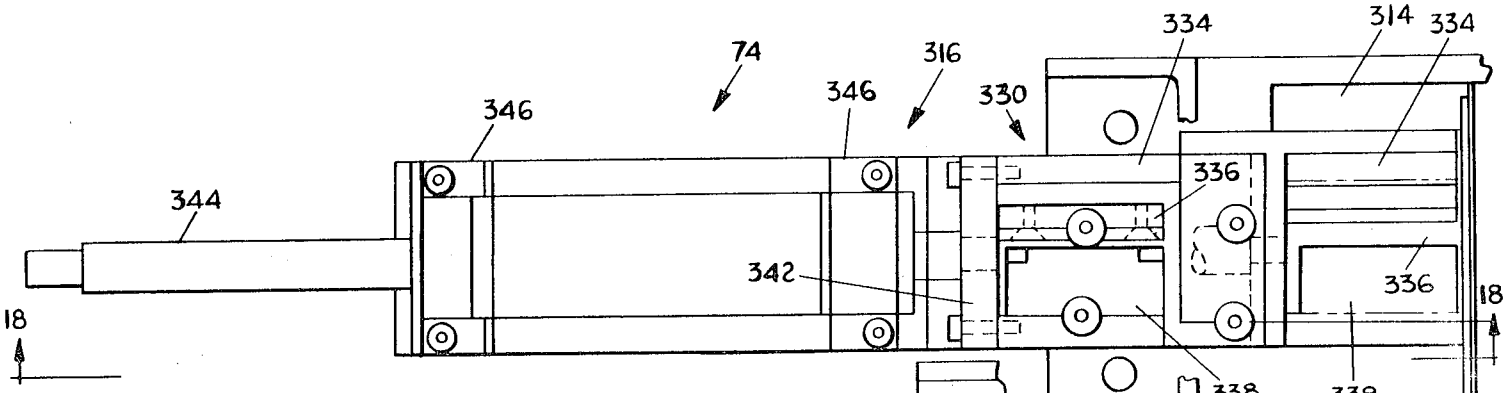
FIG. 17 is a top view of the racking spline insertion assembly seen along line 17—17 of FIG. 16.
Figure 18:
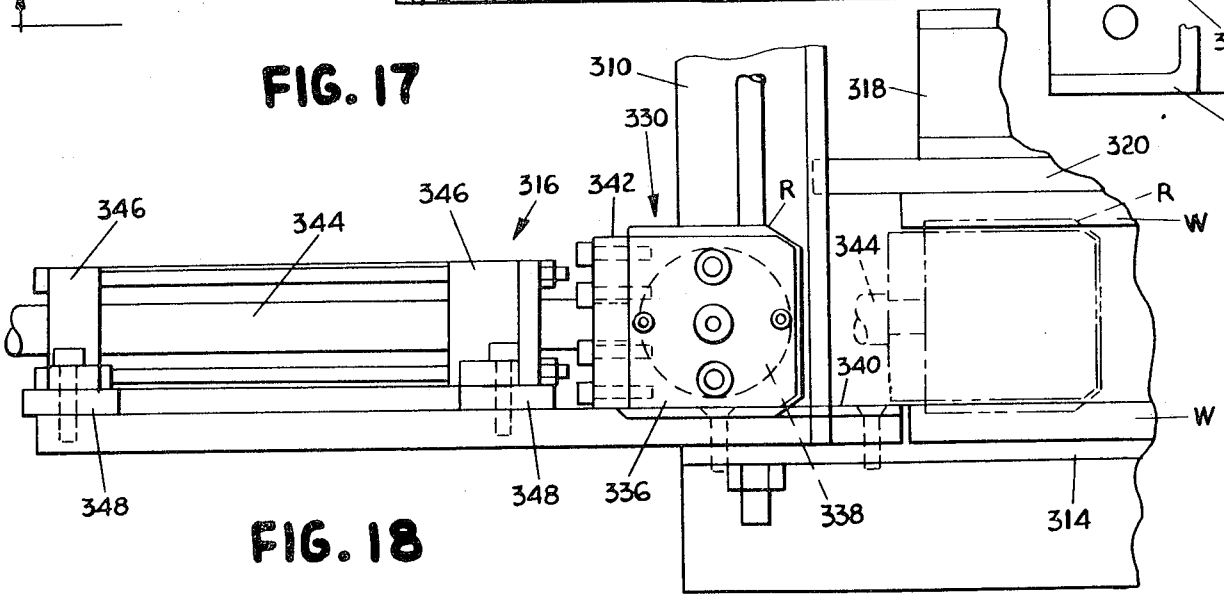
FIG. 18 is a side elevational view of the racking spline insertion seen along line 18—18 of FIG. 17.

The racking spline unit 76 includes a frame 310 which is shown in part in FIGS. 16–18. The frame 310 generally comprises upstanding beams 312. Disposed across the frame 310 is a bed 314 on which the pallet is seated during insertion of the racking splines R. The frame 310 supports a selected number of racking spline insertion stations 316. For example, four stations 316 may be positioned on the frame 310 so as to insert two racking splines R into opposing sides of the pallet. The particular details of the station 316 are described below.

Extending across the width of the frame 310 is at least one I-beam 318 mounted for vertical reciprocation over the pallet. The number of I-beams 318 is selected in view of the number of racking splines R to be inserted into the pallet. In the case of four such splines, two I-beams 318 are mounted for reciprocation on the frame 310, each over the section of the pallet where the short splines R are to be inserted. Each I-beam 318 is generally parallel to and spaced above a slat W which forms a part of the platform of the pallet. Attached to the bottom surface of the I-beam 318 is a pad 320 which provides a clamping area for seating against the slat W. The pad 320 is preferably a steel plate which is welded to the I-beam 318.

The I-beam 318 shown in FIG. 16 is shown in both the raised and lowered position. In this regard, the I-beam 318 is secured to a rod 322 which is extended and retracted by an air cylinder or the like (not shown). The size of the cylinder is selected to provide a sufficient clamping force to hold the pallet against the bed 314 to prevent the slats W from riding up as the spline R is inserted.

The splines R are inserted by a clamp assembly, generally designated as 330, which is actuated by a cylinder or the like (not shown). A plurality of such clamps 330 may be driven by a common air cylinder or each one may be driven by an individual cylinder connected to a common control. Each clamp 330 includes a stationary jaw 334 and a movable jaw 336 which is actuated by a pancake cylinder 338. The spline R is thus securely clamped between the two jaws 334, 336 for advancement between the slats W so as to embed the spline R into the slats W. The clamp assembly 330 rides over the bed 314 on which the pallet is seated. The bed 314 includes a groove or recess 340 in which the spline R is aligned. The groove 340 is formed in the bed 314 so that the bottom portion of the spline extends below the inner surface of the bottom slat of the pallet. In this way, as the clamp 330 is advanced, the edge of the spline will become embedded in the slat. The top portion of the spline likewise extends at the top between the jaws 334, 336 for embedding into the slat. The entire clamp assembly 330 is advanced between the top and bottom slats of the pallet with the clamp 330 having a predetermined extension.

The entire clamp assembly 330 is secured to a plate 342 mounted to a rod 344 which is supported on two bearings 346 mounted on spacers 348. The spacers 348 center the rod 344 between the upper and lower slats of the pallet. The two bearings 346 maintain the travel of the rod 344 along a straight line so that the spline is inserted perpendicular to the elongate splines. The rod 344 is driven by the air cylinder. The rod 344 and bearings 346 extend through one of the upright frame members 312 which has an area burned out so as to allow for reciprocation of the rod 344. When the racking spline R is inserted into the clamp 330 its back edge rests against the plate 342 to which the rod 344 is attached. No other form of guides such as pins or other holding mechanisms are needed to maintain the spline R in alignment between the jaws 334, 336 of the clamp 330.

In operation, a pallet is advanced onto the bed 314 for insertion of the racking splines R. It is contemplated that the pallets will be automatically transferred to the unit 76. In this regard, as the pallets exit the clamping assembly 70 of the pallet manufacturing machine, the bottom chains 12–18 propel the partially completed pallet forward onto an extension of the frame. As the next pallet is completed, it likewise is propelled out of the clamping assembly 70 by the chains 12–18 and thus forces the first pallet forwardly along the frame into the racking spline assembly unit 76. In this way, the need for registration between the spline clamping assembly 70 and the racking spline unit 76 is avoided so that each unit operates independently and the failure of one unit would not cause a shut down of the other.

Once the pallet is positioned on the bed 314, the air cylinder which lowers the I-beam 318 is actuated so as to clamp the pallet between the I-beams 318 and the bed 314. The clamping prevents the slats from riding up as the racking spline R is inserted. The I-beams 318 also tend to prevent cracking of the slat W as the spline R is inserted. The pancake cylinder 338 is then actuated so as to securely grip the racking spline between the stationary jaw 334 and movable jaw 336 of the clamp 330. Finally, the cylinder which drives the rod 344 on which the clamp assembly 330 is mounted is actuated so as to drive the entire clamp between the upper and lower slats W of the pallet and thus embed the spline R into the slats W. A number of such splines R can be simultaneously inserted between the slats W. After the splines R have been inserted, the rod 334 and clamp assembly 330 are withdrawn from between the slats and the cycle is repeated. The splines R are fed between the jaws of the clamp 330 by a magazine.

It is contemplated that the racking spline assembly unit 76 would simultaneously insert four splines R along opposing sides of the pallet. If a greater or lesser number of splines R is desired, the appropriate number of driving mechanisms for inserting the splines R will be provided. The racking spline assembly unit 76 is mounted at the discharge of the chain drives.

The above-described assembly provides a simple apparatus for inserting short splines R into the pallet at right angles to the elongate splines S which hold the top and bottom slats W of the pallet together. The short splines prevent racking or skewing of the top and bottom platforms of the pallet during handling and provide a three dimensional rigidity to the pallet. The racking spline insertion can be carried out by an automatic control mechanism wherein splines R are fed into the clamp by a magazine and the actuation of the various cylinders for operating the various clamping mechanisms are carried out in a selected time sequence without the need for manual control.

Figure 19:
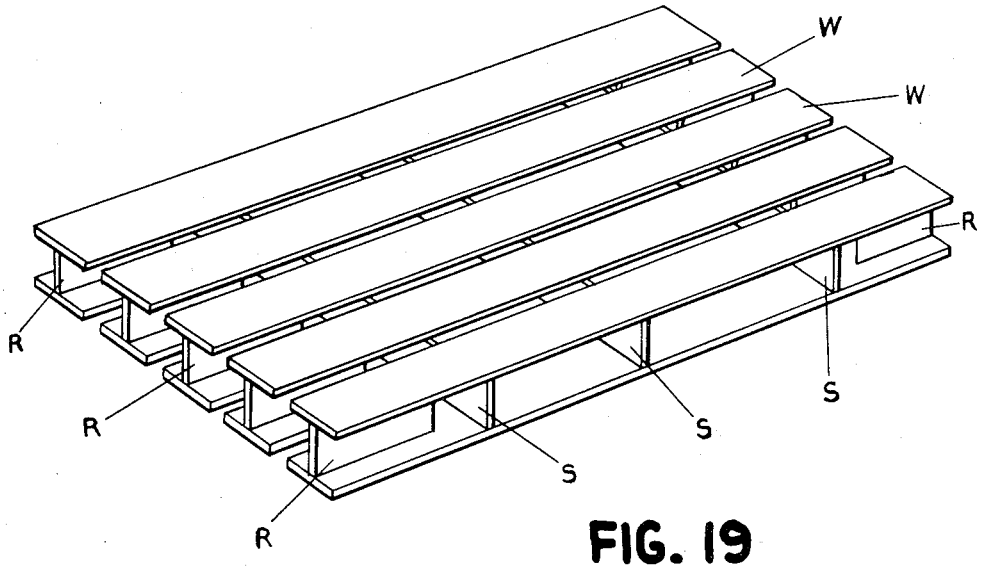
FIG. 19 is a perspective view of a completed pallet.

The completed pallet is shown in FIG. 19. The pallet is constructed of a number of slats W joined by elongate S and short splines R and is assembled in the manner described above. Further details of the pallet are set forth in the commonly-owned pending application Ser. No. 203,618, filed Nov. 3, 1980, now abandoned.

The foregoing and description of drawings are merely illustrative of the invention and are not intended to limit the invention to the above-described embodiments. Variations and changes which may be obvious to one skilled in the art may be made without departing from the scope and spirit of the invention as defined in the appended claims.

The embodiments of the invention in which an exclusive property or privilege is claimed are defined as follows:

1. A machine for assembling wooden members and elongate splines having front and back ends and edge portions extending along the length of the spline into an integrated structure wherein said wooden members form first and second platform means in spaced planes joined together by spaced elongate splines for supporting loads thereon, said machine comprising:

a frame;

spline clamping means mounted on said frame, said spline clamping means adapted to selectively grip the sides of the elongate spline in a spaced apart relationship and release the elongate splines so that the edge portions of the spline extend from said clamping means;

first and second advancing means for carrying first and second platform means along said frame and parallel to the elongate axes of the clamped splines;

said first and second advancing means adapted to force said first and second platform means over and onto the extending edges of said splines so as to embed said first and second platform means onto said splines;

drive means for displacing said first and second advancing means along said frame; and control means for opening and closing said clamping means in synchronization with said advancing means, said clamping means being closed at least during the period when said first and second platform means are forced over the extending edges of said splines;

wherein said platform means are supported on said advancing means and embedded onto the edges of said splines so as to form a structure having first and second load-bearing platforms.

2. The machine of claim 1 wherein said spline clamping means includes at least two laterally spaced spline clamping assemblies.

3. The machine of claim 2 wherein each of said at least two spline clamping assemblies includes two opposing jaw members mounted for relative reciprocal movement and means for reciprocating said jaw members between a clamping position and an open position.

4. The machine of claim 3 wherein one of said two jaw members is stationary and the other of said two jaw members is attached to at least one rod member, said at least one rod member being operatively connected to at least one cylinder means for reciprocating said at least one rod member and attached jaw member.

5. The machine of claim 3 wherein said elongate spline includes at least one aperture therein and one of said two jaw members includes pin means adapted to be received in said at least one aperture in said elongate spline for supporting said spline in said clamping assembly.

6. The machine of claim 2 further including support means secured to said frame and positioned beneath said spline clamping assemblies for selectively supporting said spline clamping assemblies during movement of said platform means.

7. The machine of claim 6 wherein said support means includes means for reciprocating said support means between a first position so as to engage said clamping assemblies and a second position out of engagement with said clamping assemblies.

8. The machine of claim 7 wherein said support means includes two support stations spaced along the length of said splines.

9. The machine of claim 8 wherein each of said support stations includes at least two laterally spaced block members, each of which is positioned below one of said at least two spline clamping assemblies.

10. The machine of claim 8 wherein said support stations are secured to a common rod, said rod being reciprocated by a cylinder between said first and second positions.

11. The machine of claim 10 further including control means for regulating actuation of said cylinder so as to reciprocate said support stations between said first and second positions.

12. The machine of claim 11 wherein said control means includes a trip mechanism which is disposed in the path of one of said two platform means for engagement thereby, said trip mechanism being operably connected to said cylinder for reciprocating said support stations so that engagement of said trip mechanism by one of said platform means causes said cylinder to reciprocate said support stations between said first and second positions.

13. The mechanism of claim 8 including two trip mechanisms disposed along the length of said splines, each of said two trip mechanisms being operably connected to said support stations so that engagement of said trip mechanisms by said platform causes said support stations to reciprocate between said first and second positions in a selected sequence.

14. The machine of claim 1 wherein said first advancing means includes at least two spaced apart chains mounted for rotation along said frame parallel to the elongate axis of said clamped splines.

15. The machine of claim 14 including two shaft means journalled on said frame for supporting said at least two chains during rotation thereof, said shaft means being operably connected with said drive means.

16. The machine of claim 15 wherein said shaft means includes sprockets for driving said at least two chains.

17. The machine of claim 15 wherein said shaft means are arranged on said frame so that the top lengths of the chains pass beneath said spline clamping means so as to force said first platform means over the lower of the extending lateral edges of said clamped splines.

18. The machine of claim 17 wherein said chains include lug means for engaging said platform means.

19. The machine of claim 18 wherein said lug means are selectively spaced along the length of said chains.

20. The machine of claim 15 wherein one of said two shaft means is laterally adjustable relative to the second of said two shaft means.

21. The machine of claim 14 further including hopper means for dispensing said first platform means onto said chains.

22. The machine of claim 14 further including switch means for controlling movement of said chains in synchronization with opening and closing of said clamping means, said switch means being operatively connected to said driving means.

23. The machine of claim 1 wherein said second advancing means includes at least two spaced apart chains mounted for rotation along said frame parallel to the elongate axis of said clamped splines.

24. The machine of claim 23 including shaft means journalled on said frame for supporting said at least two chains during rotation thereof.

25. The machine of claim 24 wherein said shaft means includes sprockets for driving said at least two chains.

26. The machine of claim 23 wherein the top lengths of said at least two chains pass over said spline clamping means so as to force said second platform means over the upper of the extending lateral edges of said clamped splines.

27. The machine of claim 26 including lug means mounted to said chains for engaging said second platform means.

28. The machine of claim 27 wherein said lug means are selectively spaced along the length of said chains.

29. The machine of claim 23 wherein said second advancing means further comprises:

a pair of spaced apart transfer chains mounted for rotation along the frame and parallel to the elongate axis of said splines;

spaced shaft means mounted to said frame for rotatably supporting said spaced apart transfer chains; and lug means for engaging said second platform means;

said pair of spaced apart transfer chains being arranged so as to carry said second platform means to said at least two spaced apart chains.

30. The machine of claim 29 including hopper means for dispensing said second platform means onto said transfer chains for engagement by said lug means.

31. The machine of claim 1 including biasing means for urging said platform means onto the extending lateral edges of said clamped splines.

32. The machine of claim 31 wherein said biasing means are positioned adjacent said spline clamping means and vertically spaced therefrom.

33. The machine of claim 32 wherein the vertical spacing between the spline clamping means and the biasing means is less than a width of one of said platform means.

34. The machine of claim 31 further including knife means for scoring an inner surface of said platform means so as to facilitate embedding onto the extending lateral edges of said clamped splines.

35. A method for assembling upper and lower platforms to at least two elongate spline members having front and back ends and lateral edge portions, the method comprising the steps of:

arranging the platforms in a generally parallel, spaced relationship;

clamping the at least two splines in a stationary joining zone and perpendicular to the planes in which the platforms lie;

advancing said platforms into the joining zone from one end thereof and guiding said platforms over and onto the lateral edge portions of the splines so as to embed the lateral edges in said platforms and form an assembled structure of said platforms and splines;

unclamping said splines; and advancing said assembled structure out of said joining zone from another end thereof.

36. The method of claim 35 including the step of stopping the advancement of the platforms when the platforms reach said other end of said joining zone prior to the step of unclamping the splines.

37. The method of claim 36 wherein said arranging step includes the step of dispensing said platforms into said generally parallel, spaced relationship.

38. The method of claim 37 wherein said upper and lower platforms include a plurality of slats and the dispensing step comprises dispensing said plurality of slats seriatim.

* * * * *